US007497815B1

(12) United States Patent
Caden et al.

(10) Patent No.: US 7,497,815 B1
(45) Date of Patent: Mar. 3, 2009

(54) EXERCISE ASSEMBLY FOR THE UPPER BODY

(76) Inventors: John Caden, 144 Severino Dr., Islamorada, FL (US) 33036; John Hawk, 15201 SW. 158 St., Miami, FL (US) 33187; Patrick Jacobs, 15550 SW. 152 Ter., Miami, FL (US) 33187; Martin Thompson, 176 Worlds End Lane, Chelsfield Park, Orpington, Kent (GB) BR6 7SS ( * ) Notice: Subject to any disclaimer, the term of this patent is extended or adjusted under 35 U.S.C. 154(b) by 766 days.

(21) Appl. No.: 10/688,806

(22) Filed: Oct. 17, 2003

(51) Int. Cl.
*A63B 21/00* (2006.01)

(52) U.S. Cl. ..... 482/135; 482/92; 482/138

(58) Field of Classification Search ..... 482/44, 482/51, 54, 66–71, 92, 133–138
See application file for complete search history.

(56) References Cited

U.S. PATENT DOCUMENTS 5,911,650 A * 6/1999 Cox ..... 482/70
6,835,167 B2 * 12/2004 Schmidt ..... 482/70

* cited by examiner

*Primary Examiner*—Glenn Richman
(74) *Attorney, Agent, or Firm*—Malloy & Malloy, P.A.

(57) ABSTRACT

An exercise assembly designed to exercise the upper body including the arms, shoulders, upper back and muscles associated therewith. The exercise assembly is thereby particularly, but not exclusively, adapted for use by an injured person or invalid having limited use of the legs and/or lower torso. A track assembly includes two track segments disposed in a convergent configuration and at least partially defining an open end dimensioned to receive a user, when in a seated, substantially upright position, at least partially therebetween. The user accesses two hand grips each linearly and reciprocally along the separate track segments. A resistance assembly includes a line interconnecting the hand grips and an adjustable resistance mechanism engaging the line so as to apply a movement restricting force thereto. An adjustable resistance is thereby applied to the linear, push/pull movement of the hand grips, as applied by the user.

12 Claims, 2 Drawing Sheets

EXERCISE ASSEMBLY FOR THE UPPER BODY

BACKGROUND OF THE INVENTION

1. Field of the Invention

This invention is directed to an exercise assembly for working the upper body and is specifically, but not exclusively, intended for use by an invalid or other mobility limited individual, such as when seated in a wheelchair or other support. Hand grips are accessible to and linearly movable by the individual in a push/pull manner, along a track assembly configured to provide the intended motion to the hands, arms, shoulders, etc. of the user. A movement restricting force is applied to the hand grips so as to vary the amount of force required of the user in moving the hand grips.

2. Description of the Related Art

In modern day society routine exercise has become increasingly popular as a means to lose weight, maintain muscles and provide for better overall health. Numerous exercise devices are currently available to an individual, depending upon the goals one wishes to attain. In addition to common, cardiovascular exercises such as running, jogging, walking, the exercise industry has developed numerous machines and exercise equipment. Such known devices are designed and structured to exercise the entire body by the performance of various prescribed exercise procedures. In addition, specialized exercise devices are available which are structured to concentrate on certain parts of a person's body.

Before the existence of present technological advancements, perhaps the most common exercise equipment comprised "free weights". As such, a plurality of different barbells and like free weight structures were used in combination with specific exercises in an effort to develop the arms, legs, shoulders and various other parts of the human body. However, for years free weights and a majority of the exercise equipment which was made commercially available was designed for individuals having the full use of their entire body. Except recently, relatively few exercise machines or like equipment was available for use by individuals with some type of physical handicap. More specifically, individuals suffering from spinal cord injuries and having lost the use of the legs or lower part of the body are typically restricted to travel by means of a wheel chair or like manual or motorized propulsion device. Further, such individuals were significantly restricted from using conventional, full body or specialized exercise equipment which was originally intended for use by individuals not having a physical handicap.

Because of the recognized need of the handicapped for exercise and/or therapy, there currently exists numerous exercise machines, specialized devices and like equipment which are specifically intended for use by physically challenged individuals. Such individuals commonly have the free use of the arms, hands, shoulders, and upper torso above the waist. However, it has recently been determined that a significant amount of the currently and commercially available exercise devices intended for the handicapped provide a type of exercise which is less than totally beneficial. By way of example, the majority of the restricted exercise equipment are designed to provide "arm cranking" or other arm exercise procedures in order to develop and maintain and rehabilitate the muscles of the upper part of the body. Unfortunately, participation in these activities have been associated with increased incidences of upper extremity injuries and pain. Moreover, medical professionals have suggested that the movement pattern and muscle utilization involved in these arm cranking or continuous rotational movements involve an excessive shoulder pressing action in an internally rotated position. The result is the production of an unbalanced stress and a repetitive use syndrome.

To the contrary, several pieces of conventional and existing exercise equipment not capable of being used by invalids or other physically restricted individuals offer a lower body cycling motion concurrently with a reciprocal press/pull arm action. Such devices include various exercise bicycles and elliptical runner systems. The action provided with such systems is further characterized by linear hand movement. These systems provide a much greater shoulder range of motion than the rotational arm cranking procedure as described above. In addition shoulder extension resulting from pulling the arm past the mid-line of the body is also extremely beneficial. The muscles involved in such pulling actions include the latisimus dorsi, rhomboids, rear deltoid and rotator cuff muscles. Obviously, persons with significant torso disabilities are not able to use such system. As a result, the aforementioned muscle groupings are typically under developed and without significant resting tone when the user is restricted to a wheel chair.

Accordingly, there is a significant need in the exercise industry for an exercise assembly specifically, but not exclusively, intended for use by handicapped individuals of the type set forth above. Such an improved exercise assembly should be able to provide linearly directed push/pull motions of the arms, shoulders, etc. rather than the aforementioned arm cranking motion. Also, a preferred exercise assembly should be readily adaptable in terms of positioning, dimensioning and overall structural configuration for use by individuals who are primarily oriented in a seated but substantially upright position, such as when the individual is supported in a wheel chair. Moreover, a preferred and improved exercise and rehabilitation device should be structured to provide linear and reciprocal action arm movement while in a seated position.

SUMMARY OF THE INVENTION

The present invention is directed to an exercise assembly for exercising muscles of a user's upper body. More specifically, the exercise assembly of the present invention is particularly, but not exclusively, intended for use by individuals having restrictive use of the lower part of the body and as such may be required to use a wheelchair for mobility. Therefore, an important feature of the exercise assembly of the present invention, as will be described in greater detail hereinafter, is the provision of an exercise motion which provides linear action due to reciprocal arm movement while the user or individual is in a seated position.

In accomplishing the intended goals, the exercise assembly of the present invention comprises a frame including a base disposed on a supporting surface. The frame also includes a track assembly connected to and supported by the base. The base, and/or a cooperative portion of the frame is adjustably connected or attached so as to vary the height of at least the track assembly relative to the supporting surface. The subject exercise assembly is thereby adaptable to an individual of varying size, wherein the individual may be restricted to utilizing wheelchairs of various sizes, shapes, etc. In addition, the track assembly includes an open substantially front end portion and a closed end located at a rear or trailing portion of the frame and being oppositely disposed to the open end of the track assembly. Moreover, the track assembly comprises two track segments extending from the open end to the closed end and as such are collectively disposed in a substantially convergent configuration. Each of the track segments are elongated, linear, hollow and have a substantially equal longitudinal dimension.

A carriage assembly is reciprocally and linearly movable along the track assembly and as such includes two hand grips readily accessible to the user when the user is disposed in an operative position. Generally speaking, the operative position of the individual may be defined by a location substantially on the "interior" of the track assembly or at a location which is between the spaced apart converging track segments at least in the vicinity of the open end thereof. Therefore, the open end of the track assembly must be sufficiently dimensioned to allow disposition of the user in an operable position, while in the preferred, seated but upright orientation. In such an operable position the hands of the user can easily grasp different ones of the hand grip.

The carriage assembly more specifically includes two carriages each structured to support and be fixedly connected to one of the two hand grips. In turn, each of the carriages are movably connected to a different one of the track segments so as to be capable of the aforementioned and preferred linear and reciprocal motion along the respective track segments. As will be described in greater detail hereinafter, each carriage is structured to be movably connected within the interior of the respective track segment, while having an outer, exterior, shell-like portion to which corresponding ones of the hand grips are mounted.

One additional feature of the present invention is the provision of a resistance assembly which is interconnected between the two carriages and otherwise structured to provide a movement restricting force thereon. Such a restrictive force offers resistance to the reciprocal, linear motion of the hand grips along their respective track segments and therefore requires a user or individual to exercise the intended muscle grouping to cause the continuous travel of the hand grips along their respective track segments. Moreover, the resistance assembly includes an elongated line, cable, belt, etc. extended along a predetermined path of travel at least partially defined by the lengths of the individual track segments. As also will be discussed in greater detail, the line preferably includes a continuous or closed configuration. While continuous, the line is adjustable and/or separable at one or more locations along its length such that the relative positions of the carriages and the corresponding hand grips are adjustable relative to one another. Access to and the intended concurrent reciprocal motion of the hand grips, as performed by the user is thereby facilitated.

The aforementioned predetermined path of travel is further defined by a plurality of pulleys or rollers disposed along the length of the path in movable engagement with the line. In addition, the resistance assembly further includes a resistance mechanism preferably in the form of a roller. The resistance mechanism or roller can be rotated in opposite directions to accommodate the reciprocal movement of the line and the carriages and hand grips attached thereto. Also, the resistance to such reciprocal rotation of the resistance roller may vary in order to selectively and adjustably determine the amount of resistance placed on the line and accordingly the amount of restrictive force required to reciprocally "push and pull" the hand grips by the user. A number of adjustable resistance producing structures may be utilized in cooperation with the resistance roller mechanism such as friction engaging implements, adjustable gearing, or other mechanical or hydraulic devices.

Therefore, operation of the exercise assembly of the present invention as intended, provides a user with a linearly acting reciprocal arm movement while in a seated but substantially upright position, such as in a wheelchair. Further, the individual and the wheelchair or other means of support may be disposed in an operable position, partially within the "interior" of the track assembly in the specific vicinity of the open end thereof. The preferred exercising procedure involves griping each of two hand grips associated with different ones of the track segments and providing alternating, linear, reciprocating, push/pull motion which serves to best exercise the intended muscle grouping in a preferred manner. The problems and disadvantages associated with the aforementioned rotary or "arm cranking" motion are thereby overcome. Further, in order to facilitate the performance of such a preferred exercising motion, the track assembly may be supported on the base at a predetermined inclination of preferably, but not necessarily, 18 to 20 degrees.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 3:
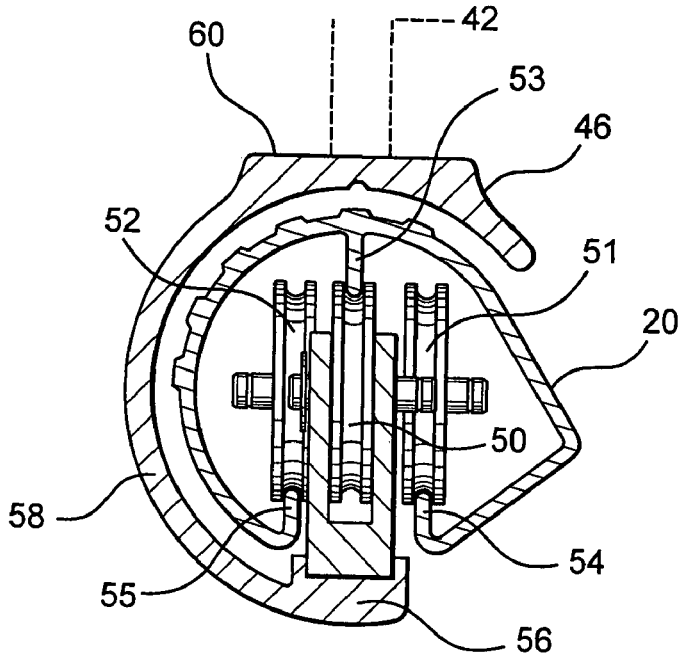
FIG. 3 is a sectional view taken along line 3-3 of FIG. 1.

As shown in the accompanying drawings, the present invention is directed to an exercise assembly generally indicated as 10 and including a frame generally indicated as 12 having a base 14. The frame 12 further includes a track assembly generally indicated as 16 including a plurality of track segments, preferably two in number respectively indicated as 18 and 20. The track segments 18 and 20 are linear and have a hollow configuration along at least a majority of the length thereof as demonstrated in FIG. 3. The base 14 supports the remainder of the frame 12, including the track assembly 16 on any of a number of different supporting surfaces 22. The base 14 and a remainder of the frame 12 is cooperatively structured to be height adjustable as indicated by directional arrow 24. As such, the base 14 may include telescopic sections 26 and 28 adjustable vertically relative to the supporting surface 22 either by the use of hydraulics or mechanics, as is well known in the art.

Figure 2:
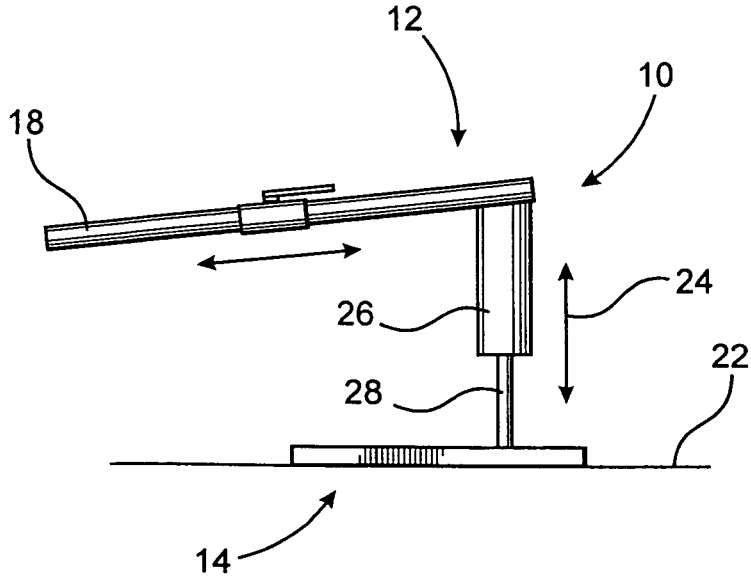
FIG. 2 is a side view of the embodiment of FIG. 1 in schematic form.

The track assembly 16, including the two track segments 18 and 20 having a front, substantially open end of the frame 12 as at 30 and a closed or rear end of the frame 12 generally indicated as 32. Accordingly, the track segments 18 and 20 are cooperatively configured into a convergent configuration as they extend from the front portion or open end 30 to the rear or closed end 32 of the track assembly 16. Further, the track segments 18 and 20 are disposed in a substantially coplanar orientation with one another and are collectively disposed at an incline as demonstrated in FIG. 2. While not limited to a specific angle of inclination, a most preferred angle of inclination would be generally about 18 to 20 degrees in order to best facilitate operation of the exercise assembly 10 in the intended fashion.

As set forth above the exercise assembly 10 is specifically, but not exclusively, designed for use by an individual disposed in a seated but substantially upright orientation, such as the orientation actually assumed when seated in a wheelchair or other support means. Accordingly, the open end 30 of the front portion of the frame 12 must be at least sufficiently dimensioned, in terms of the spacing between the proximal ends 18' and 20' of the track segments 18 and 20 to allow receipt and/or passage and positioning of the user on the "interior" 36 in the vicinity of the open end 30 and between the proximal ends 18' and 20'. When in this operable position, the user has free and easy access to two hand grips 40 and 42.

The hand grips 40 and 42 comprise an operable part of a carriage assembly. The carriage assembly further comprises two carriages 44 and 46, the details of which are disclosed in greater detail in FIG. 3, with specific reference to the carriage 46. While reversely oriented, the carriages 44 and 46 are each connected in supporting relation to the different hand grips 40 and 42 and are otherwise identically structured. Therefore, with primary reference to FIG. 3 the carriage 46 includes a roller assembly comprising at least one but preferably a plurality of rollers 50, 51 and 52. The rollers are mounted within and structured to travel along the hollow interior of the respective track segment 20. Further, each of the rollers 50, 51 and 52 associated with each carriage 44 and 46 is disposed, dimensioned and structured to rotationally engage interior portions of the respective track segments 18 and 20 which are more specifically defined by inwardly directed or extending rails 53, 54 and 55. The roller assembly is mounted as a unit which is fixedly secured to a depending flange portion 56 of the carriage 46. The remainder of the carriage 46 comprises a shell-like configuration, as at 58 which is disposed exteriorly of the track segment 20 and in at least partially or substantially surrounding and enclosing relation to a portion thereof as demonstrated. Each of the carriages 44 and 46 may include a flat or support platform as at 60 for supporting attachment to a corresponding one of the hand grips schematically indicated in phantom as 42. It should be apparent that the cooperative disposition of the inwardly directed rails 53, 54 and 55 and their engagement with the respected rollers 50, 51 and 52 cause a secure but linearly movable engagement of each of the carriages 44 and 46 both interiorly and exteriorly of the respective track segments 18 and 20.

Figure 4:
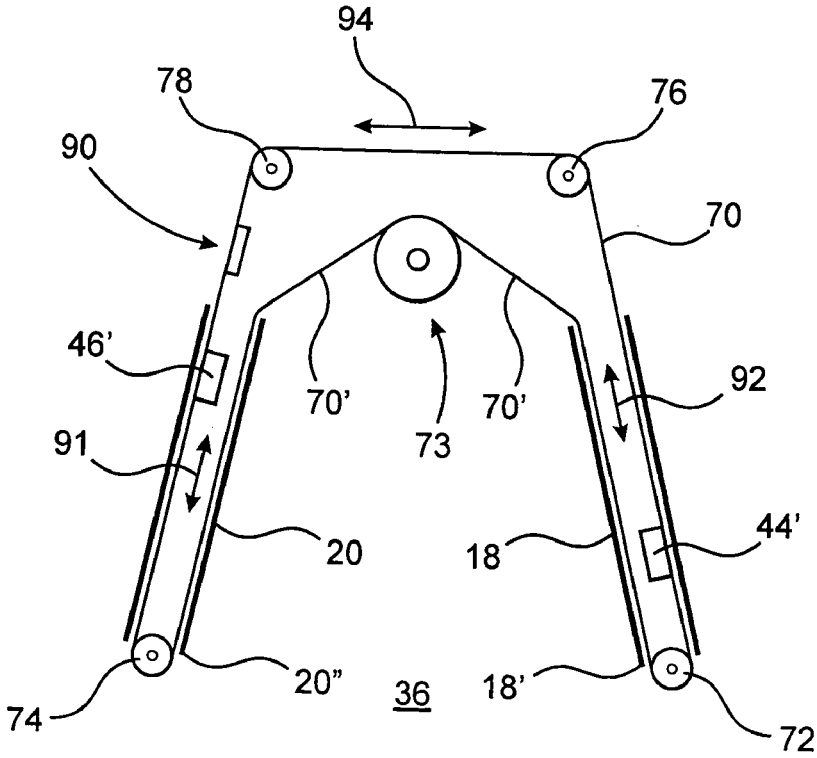
FIG. 4 is a schematic representation showing both operative and structural features of the exercise assembly of the present invention.

With primary reference to FIG. 4 structural and operative features of the exercise assembly 10 are schematically demonstrated. More specifically the exercise assembly 10 includes a resistance assembly comprising an elongated line, cable, belt, etc. 70. The line 70 extends along a predetermined path of travel which is partially defined by the two track segments 18 and 20 as correspondingly positioned lengths of the line 70 are mounted within and movable along an interior portions of the respective track segments 18 and 20. The predetermined path of travel of the line 70 is further defined by appropriately disposed rollers or pulleys 72 and 74 located within and substantially adjacent to the proximal end and 18' and 20' of the track segments 18 and 20. Additional guiding pulleys or rollers 76 and 78 are disposed adjacent the closed end 32 of the track assembly 16 at the rear portion thereof as described above. Further, the pulleys 76 and 78 are located exteriorly of the track segments 18 and 20.

The path of travel of the line 70 is further defined by the inclusion of a resistance mechanism or resistance roller 73 which engages a correspondingly positioned length of the line 70 as at 70'. Movable engagement between the line segment 70' and the resistance mechanism or roller 73 provides a movement restrictive force on the line 70. Such a restrictive force in turn causes the user of the exercise assembly 10 to exert a comparable force on the hand grips 40 and 42 in order to accomplish the intended linear, reciprocal, push/pull motion by the arms, shoulders, etc. of the upper torso of the user.

Figure 1:
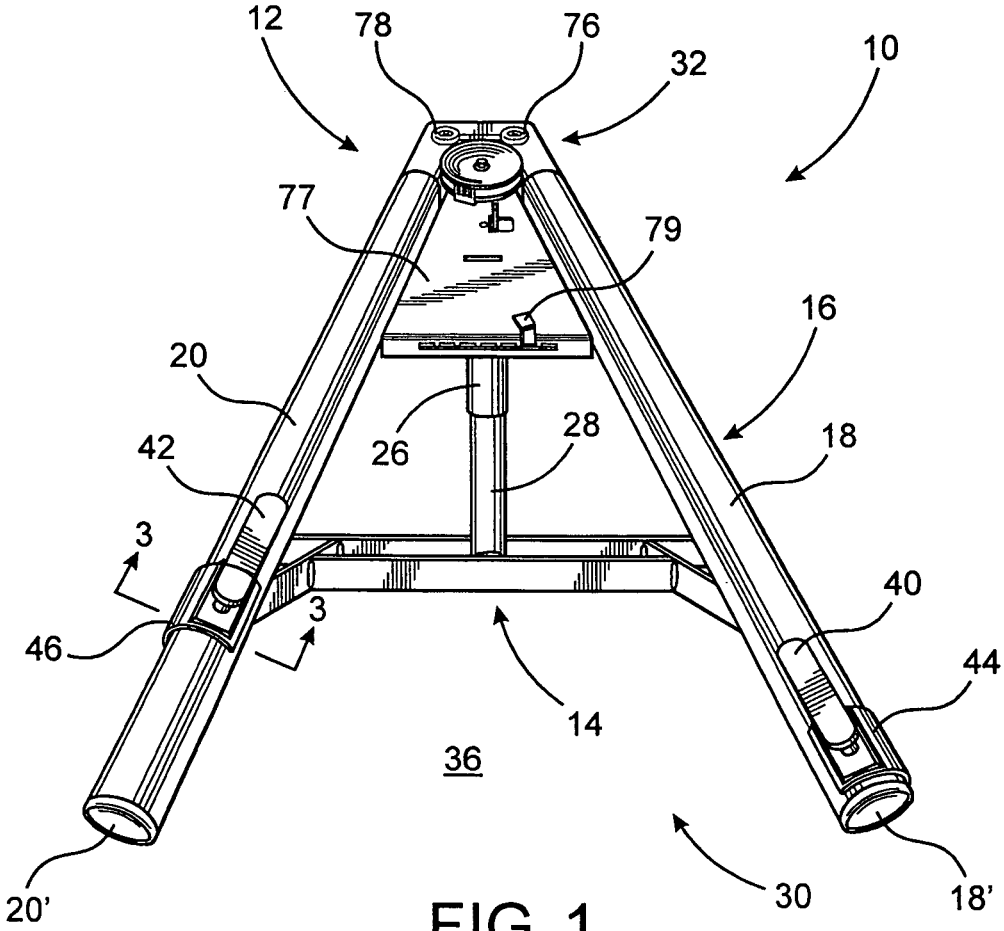
FIG. 1 is a front perspective view of the exercise assembly of the present invention

With reference to FIG. 1 a housing as at 77 includes a resistance exerting mechanism (not shown for purposes of clarity) which may take a variety of different configurations and be cooperatively structured with the resistance mechanism or roller 73 to provide the aforementioned movement restricting force on the line 70 during its reciprocal movement. Further the resistance exerting device within the housing 77 is adjustable by means of operative positioning of a lever 79. Depending upon the orientation of the lever 79 a selective amount of resistance will be placed on the line 70. The user is thereby capable of adjusting the force required to reciprocally move the hand grips 40 and 42 over their intended linear paths along the track segments 18 and 20. A variety of different resistance exerting devices may be enclosed within the housing 77. Such devices may include friction engaging devices, gear assemblies other hydraulic or mechanical operative devices known in the art. Such devices are cooperatively structured with the pulley 72 to vary the amount of restrictive force placed on the line 70 which is required to reciprocally move the hand grips 40 and 42 in the manner described.

With further referenced to FIG. 4 it is seen that the line 70 has a substantially continuous or closed configuration as it is disposed along the aforementioned path of travel defined by the roller 72, 74, 76, 78 and the resistance mechanism roller 73. Such a closed or continuous configuration is further defined by the line 70 being attached to the respective carriages 44 and 46 and/or the roller assemblies associated therewith, as described in FIG. 3 at points 80 and 81 as demonstrated. Also in order to vary the overall length of the line 70 and/or vary the position the carriages 44' and 46' relative to one another at different locations an adjustment assembly is provided and generally indicated as 90. The adjustment assembly 90 includes means to disconnect portions of the line 70 from one another and/or reconnect the separated portions at different locations such that the positions of the hand carriages and hand grips may vary, as set forth above.

As indicated by the directional arrows 91, 92 and 94, the line 70, while in the aforementioned closed or continuous configuration and oriented along the predetermined path of travel continuously moves in a reciprocal manner as the user of the device, operatively positioned on the interior 36 adjacent the open end 30, alternately exerts a push/pull force on each of the hand grips 40 and 42 resulting in the preferred and intended linear, reciprocal motion best suited to accomplish the intended exercise and/or rehabilitation.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An exercise assembly for a user's upper body, said exercise assembly comprising:

a) a frame at a spaced apart distance therefrom, said spaced apart distance being adjustable, including a base disposed on a supporting surface and a track assembly fixedly connected to said frame, b) said track assembly including an open end and a closed end and two track segments collectively convergent from said open end to said closed end, c) said two track segments connected to said frame in fixed relation to one another and angularly inclined relative to the supporting surface, d) two hand grips linearly and reciprocally movable along different ones of said track segments, e) a resistance assembly including a line extending along a predetermined path of travel in interconnecting relation to said hand grips, f) said resistance assembly including a resistance mechanism engaging said line and structured to exert a movement restrictive force thereon, and g) said open end disposed and sufficiently dimensioned to at least partially receive the user between corresponding proximal ends of said two track segments while the user is in a seated, substantially upright orientation.

2. An exercise assembly as recited in claim 1 wherein said resistance mechanism is structured to vary the restrictive force and a resulting force required to move said hand grips along said track assembly.

3. An exercise assembly as recited in claim 1 wherein said track segments are substantially coplanar with one another.

4. An exercise assembly as recited in claim 1 further comprising a carriage assembly including at least two carriages each supporting a different one of said hand grips.

5. An exercise assembly as recited in claim 4 wherein said line is interconnected and movable with said carriages along said path of travel.

6. An exercise assembly as recited in claim 4 wherein said two track segments each have a linear, at least partially hollow configuration.

7. An exercise assembly as recited in claim 6 wherein said two carriages are movably connected both externally and internally to corresponding ones of said track segments.

8. An exercise assembly as recited in claim 7 wherein each of said carriage assemblies includes a roller assembly rotationally engaging interior portions of corresponding ones of said track segments.

9. An exercise assembly as recited in claim 8 wherein each of said track segments comprise a rail assembly disposed within and extending along a length thereof, said rail assembly and said roller assembly cooperatively structured to movably secure each of said carriages to corresponding ones of said track segments.

10. An exercise assembly as recited in claim 9 wherein each of said carriages include a shell disposed externally of and in at least partially surrounding relation to corresponding ones of said track segments.

11. An exercise assembly as recited in claim 1 wherein said track assembly is height adjustable relative to the supporting surface.

12. An exercise assembly as recited in claim 1 wherein said line is adjustable along its length and cooperatively disposed and structured with said handgrips to vary the relative positions of said handgrips upon adjustment of said line.

* * * * *